US007921918B2

(12) United States Patent
Bryant, Jr. et al.

(10) Patent No.: US 7,921,918 B2
(45) Date of Patent: Apr. 12, 2011

(54) SUPPORT APPARATUS FOR A WELL BORE TOOL

(76) Inventors: Charles Larue Bryant, Jr., LaPlace, LA (US); David J. Ruttley, Marrero, LA (US)

( * ) Notice: Subject to any disclaimer, the term of this patent is extended or adjusted under 35 U.S.C. 154(b) by 236 days.

(21) Appl. No.: 12/215,275

(22) Filed: Jun. 26, 2008

(65) Prior Publication Data

US 2009/0321592 A1 Dec. 31, 2009

(51) Int. Cl.
*E21B 29/00* (2006.01)

(52) U.S. Cl. ..... 166/351; 166/352; 166/361; 166/78.1; 166/55.7; 405/201

(58) Field of Classification Search ..... 166/351, 166/338, 339, 341, 352, 361, 368, 250.01, 166/78.1, 55.7, 298; 405/201, 195.1; 212/282, 212/283, 307, 223, 251; 248/178.1, 177.1
See application file for complete search history.

(56) References Cited

U.S. PATENT DOCUMENTS 2,638,324 A * 5/1953 Ball et al. ..... 173/149
3,981,369 A * 9/1976 Bokenkamp ..... 175/5
4,147,215 A * 4/1979 Hodge et al. ..... 166/380
4,208,158 A * 6/1980 Davies et al. ..... 414/22.68
4,209,066 A * 6/1980 Watson ..... 166/377
4,466,487 A * 8/1984 Taylor, Jr. ..... 166/339
4,479,537 A * 10/1984 Reed ..... 166/77.4
4,515,220 A * 5/1985 Sizer et al. ..... 166/384
4,843,945 A * 7/1989 Dinsdale ..... 81/57.34
4,846,271 A * 7/1989 Delesandri ..... 166/78.1
4,848,455 A * 7/1989 Fenyvesi ..... 166/77.2
4,890,671 A * 1/1990 Baxter ..... 166/250.01
5,092,399 A * 3/1992 Lang ..... 166/77.53
5,467,833 A * 11/1995 Crain ..... 175/52
5,544,979 A * 8/1996 White ..... 405/232
5,704,427 A * 1/1998 Buck et al. ..... 166/338
6,085,851 A * 7/2000 Scott et al. ..... 175/7
6,189,620 B1 * 2/2001 McDowell ..... 166/379
6,213,216 B1 * 4/2001 Rogers ..... 166/380
6,217,258 B1 * 4/2001 Yamamoto et al. ..... 405/201
6,234,253 B1 * 5/2001 Dallas ..... 166/377
6,330,918 B1 * 12/2001 Hosie et al. ..... 166/341
6,386,284 B1 * 5/2002 Buck et al. ..... 166/77.53
6,488,094 B1 * 12/2002 McDowell ..... 166/379
6,536,520 B1 * 3/2003 Snider et al. ..... 166/78.1
6,688,393 B2 * 2/2004 Sredensek et al. ..... 166/377
6,766,860 B2 * 7/2004 Archibald et al. ..... 166/341
6,976,670 B1 * 12/2005 Woolley et al. ..... 254/30
7,090,035 B2 * 8/2006 Lesko ..... 175/57
7,140,443 B2 * 11/2006 Beierbach et al. ..... 166/380
7,188,686 B2 * 3/2007 Folk et al. ..... 175/162
7,222,683 B2 * 5/2007 Folk et al. ..... 175/162
7,228,913 B2 * 6/2007 Folk et al. ..... 166/380
7,231,969 B2 * 6/2007 Folk et al. ..... 166/77.51
7,296,623 B2 * 11/2007 Koithan et al. ..... 166/250.01
7,341,109 B1 * 3/2008 McDowell ..... 166/379
7,377,324 B2 * 5/2008 Beierbach et al. ..... 166/380
7,527,100 B2 * 5/2009 Abadie ..... 166/298

(Continued)

*Primary Examiner* — Thomas A Beach
*Assistant Examiner* — Matthew R Buck
(74) *Attorney, Agent, or Firm* — Ted M. Anthony

(57) ABSTRACT

A rigless support for a downhole operation, such as cutting of an underwater casing in preparation for plug-and-abandonment. The unit has a movable base that can be positioned on a floating structure, such as a barge or a marine vessel and delivered to the site. A pair of piston rams support a swivel unit therebetween, with the swivel unit being driven by a hydraulic motor and driving a casing cutter.

21 Claims, 7 Drawing Sheets

U.S. PATENT DOCUMENTS 7,637,329 B2 * 12/2009 Stoik ..... 175/57
7,673,675 B2 * 3/2010 Carr et al. ..... 166/77.51
2007/0289738 A1 * 12/2007 Kampman et al. ..... 166/250.01
2010/0116507 A1 * 5/2010 Haugland ..... 166/352

* cited by examiner

SUPPORT APPARATUS FOR A WELL BORE TOOL

BACKGROUND OF THE INVENTION

The present invention relates to a system for use with an abandoned well of a subterranean formation containing a well bore. More particularly, the present invention relates to a rigless system for operationally supporting an apparatus designed for cutting an underwater casing.

In the production of oil and gas in subterranean formations, it is often found that a well bore that penetrates the subterranean formation must be plugged and abandoned. The plug and abandonment operations are expensive; they involve the use of valuable offshore rig space, operation of rig-mounted pedestal cranes and other platform-mounted equipment.

Conventionally, the casings are severed by an explosive charge delivered underwater to a desired depth below the bed of the body of water and detonated. However, the explosives are harmful to marine life and to the surrounding water. Additionally, the residual oil and gas may leak into the surrounding water, which raise serious concerns of contamination in that area.

As an alternative to the explosive cutting methods, the industry has developed cutting techniques that provide for the use of mechanical cutting tools activated from the surface for cutting the casing below the mud line. The majority of the tools use rig-mounted equipment, which necessitates the presence of an offshore platform in the well bore location. Some of the cutting tools are connected to an operational system suspended from a pedestal crane, and the vibrations created by the cutting operations are transmitted to the crane. Often times, the vibrations are so strong that the pedestal crane becomes unbalanced and topples. As a consequence, less powerful cutting tools have to be used, which increases the casing cutting time The present invention contemplates elimination of problems associated with convention techniques and provision of a rigless support apparatus that can be easily transported to the site of the well plug-and-abandon operation for supporting the underwater operations offshore.

SUMMARY OF THE INVENTION

It is, therefore, an object of the present invention to provide a rigless system for supporting offshore operations, such as for instance a casing cutter operation.

It is another object of the present invention to provide a support apparatus for operating a casing cutter, with the operation of the casing cutter from a small floating facility.

These and other objects of the present invention are achieved through a provision of an apparatus for supporting a casing cutter from a deck of a rigless floating vessel. The apparatus comprises a movable base that can be mounted on skids and re-positioned to be aligned with a well bore. An opening formed in the base allows access to a well bore made in a subterranean formation.

The apparatus of the present invention has a pair of spaced-apart vertical legs secured to and extending upwardly from the base, each of said legs comprising a movable portion adapted for vertical movement in relation to the base. The top parts of each of the movable portions are hydraulic rams that can move vertically in relation to the base. Each of the rams carries an alignment assembly that engages a swivel unit to move the swivel unit vertically, while retaining its relative orientation above the well bore.

The swivel unit is configured for connecting to a rotating tool for delivery of rotating force to the casing cutter and perform the cutting of successive tubulars forming the well bore casing. The swivel unit exerts a downward force on the rotating tool for activating the casing cutter when the rams move the swivel unit downwardly.

BRIEF DESCRIPTION OF THE DRAWINGS

Reference will now be made to the drawings, wherein like parts are designated by like numerals, and wherein.

DETAIL DESCRIPTION OF THE INVENTION

Figure 1:
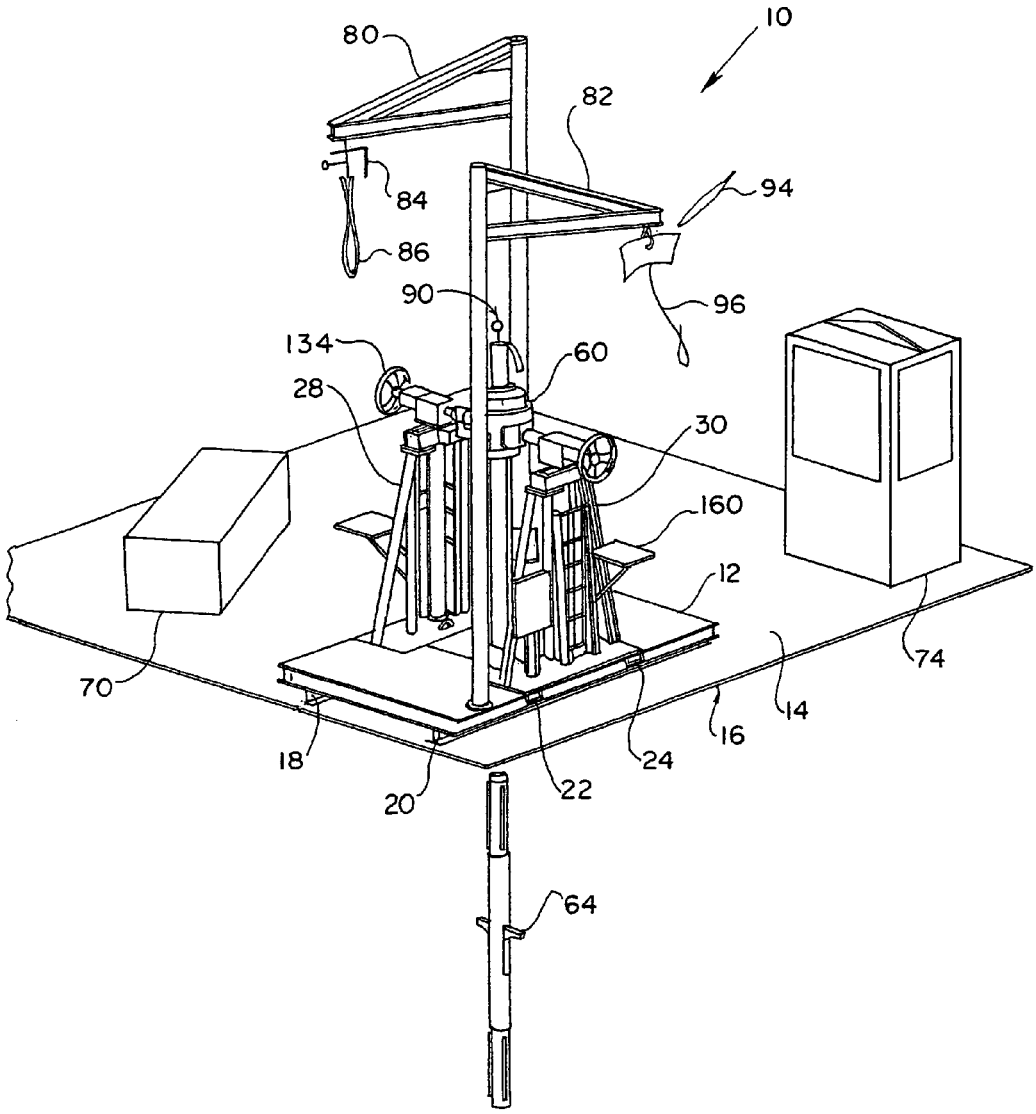
FIG. 1 is a perspective view of the support apparatus in accordance with the present invention positioned on a floating vessel.
Figure 2:
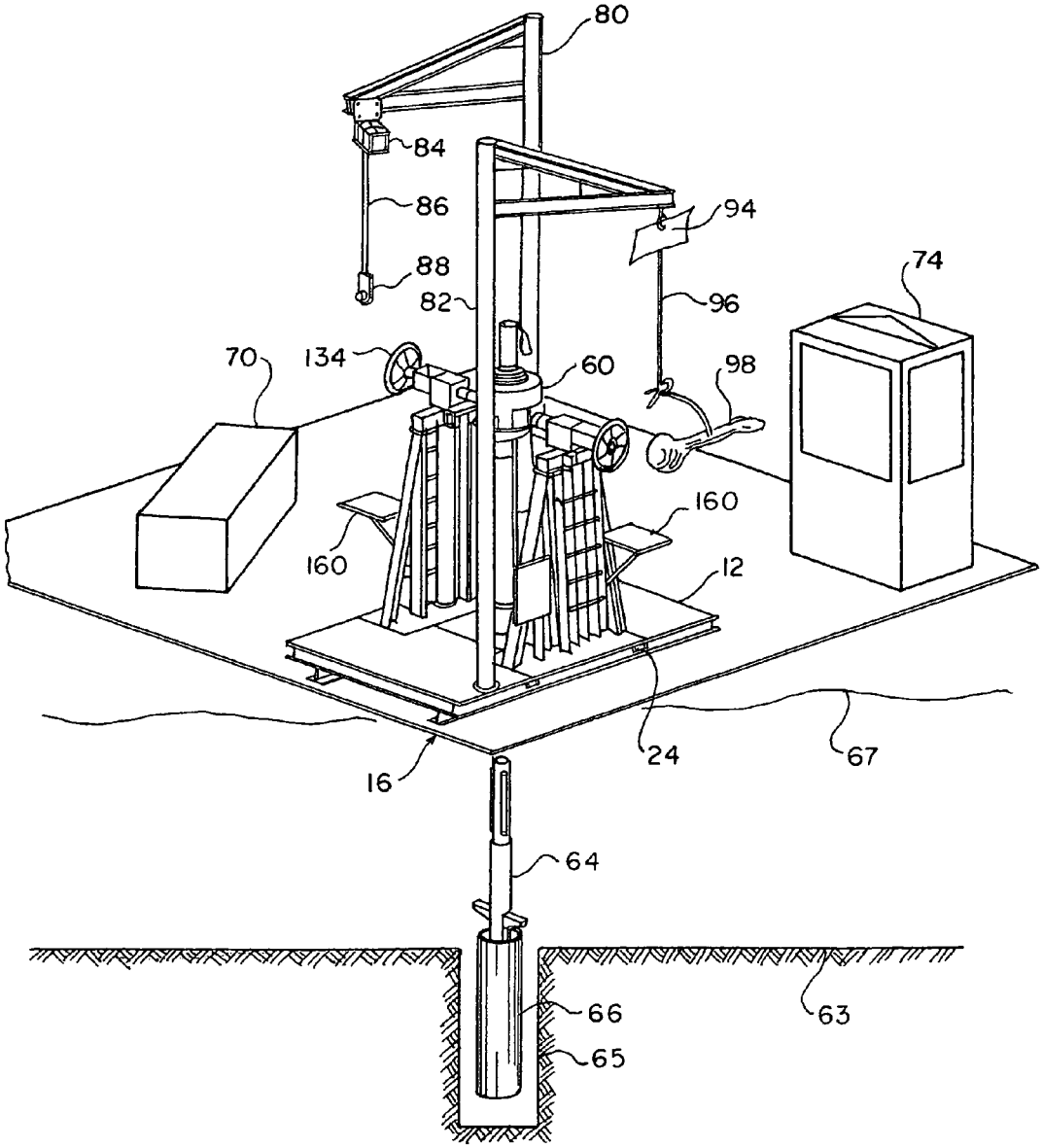
FIG. 2 is a perspective view of the apparatus of the present invention schematically showing a casing cutter engaged with a casing being severed.
Figure 3:
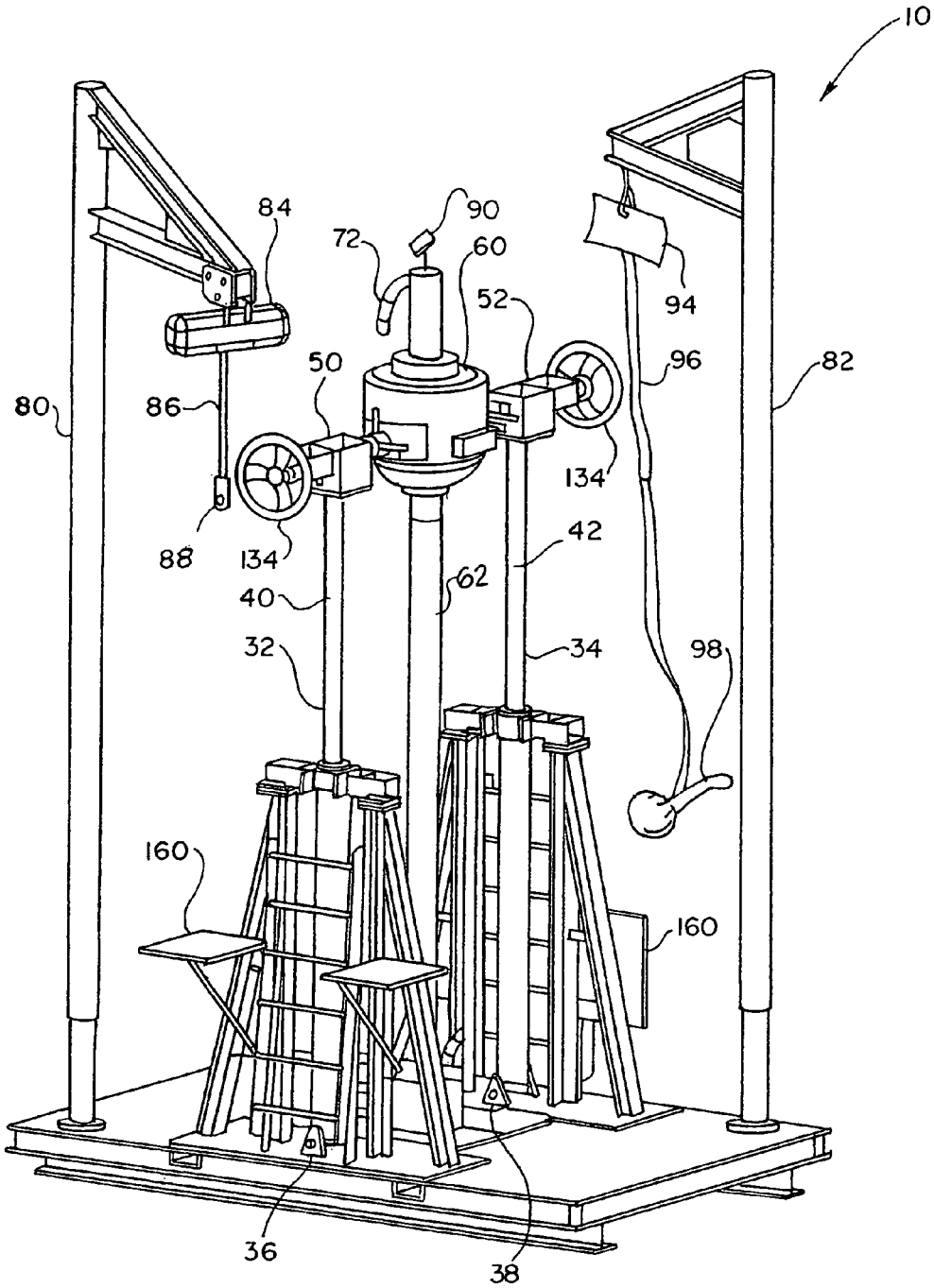
FIG. 3 is a perspective view of the apparatus of the present invention showing the power swivel unit in an elevated position on top of hydraulic rams.

Turning now to the drawings in more detail, numeral 10 designates the apparatus of the present invention. As can be seen in the drawing, apparatus 10 comprises a maneuvering support base 12 that can be moved and repositioned in any desirable location on a platform 14 of a floating vessel 16, which can be a barge, a platform and the like. The base 12 rests on a pair of skid beams 18 and 20 that allow the base 12 to be moved to a desired location about the deck 14. The base 12 is also provided with tunnels 22, 24 in the side of the base to allow the base to be re-positioned using a skid loader or forklift. Since there are several well bores formed in a small area of an ocean floor, the maneuverability of the base 12 facilitates the casing cutting operation in the desired area with significantly reduced costs. The base 12, along with the equipment positioned thereon can be easily moved along the skid beams 18, 20 to access several adjacent well bores or lifted and re-positioned in the next segment of the well bore locations using the same vessel 16.

The base 12 supports the tools and equipment necessary for conducting a well bore operation, in this case a casing cutting operation. A pair of upright supports 28 and 30 is erected on the base 12 in a spaced-apart opposing relationship to each other. The supports 28, 30 can be A-shaped structures or other vertical supporting members for supporting hydraulically-operated legs, or 32 and 34. Each of the poles 32 and 34 comprises two or more telescopically engaged sections, the bottom portion of which is firmly secured, such as by clamps 36, 38, to the top of the base 12. The legs 32, 34 each comprise hydraulic rams, or pistons 40, 42, that can be extended and retracted by an external power source, which can be a hydraulic power unit 70 mounted on the deck 14, from the lower portions of the legs.

Secured to tops of the rams 40, 42 are guiding/alignment assemblies 50, 52, respectively. The alignment assemblies 50, 52 are diametrically opposed in relation to a power swivel unit 60, with which the alignment assemblies 50, 52 come into contact, as will be described in detail hereinafter.

The power swivel unit 60 is mounted on top of a rotating tool 62. The tool 62 is configured for delivering a well bore tool such as a casing cutter 64 into a casing 66 positioned in a well bore 65 formed in the ocean floor formation 63. The vessel 16 floats on the surface of water 67 in a selected location above the well bore 65. The casing cutter 64 can be a device that actually cuts casing 66. Although many different cutting devices known to those having skill in art can be used for this purpose, in the preferred embodiment at its lower part thereof, casing cutter 64 can be a tool made according to my U.S. Pat. No. 7,063,155 entitled "Casing Cutter."

The swivel unit 60 is operated by hydraulic power supplied by the hydraulic power source 70 which is mounted on the deck 14 of the vessel 16 and is operationally connected through suitable hydraulic line 72 to the hydraulic power source 70. The apparatus of the present invention may also include an optional operator shack 74 mounted on the deck 14 to allow the operator to monitor operation of the hydraulic system and assess the status of the cutting operations, while controlling operation of the mechanical elements of the system through provided control devices.

A pair of Jen poles 80, 82 is positioned on the base 12. The Jen pole 80 carries a motor 84 that operates a cable, or chain 86 that can be wound or unwound upon activation of the motor 84. The chain or cable 86 has a hook 88 on the free end thereof. The hook 88 is configured for engaging with an eyelet 90 secured to the swivel unit 60. By activating the motor 84, an operator can move the swivel unit 60 up and down, setting the swivel unit in alignment with the alignment assemblies 50, 52.

Figure 4:
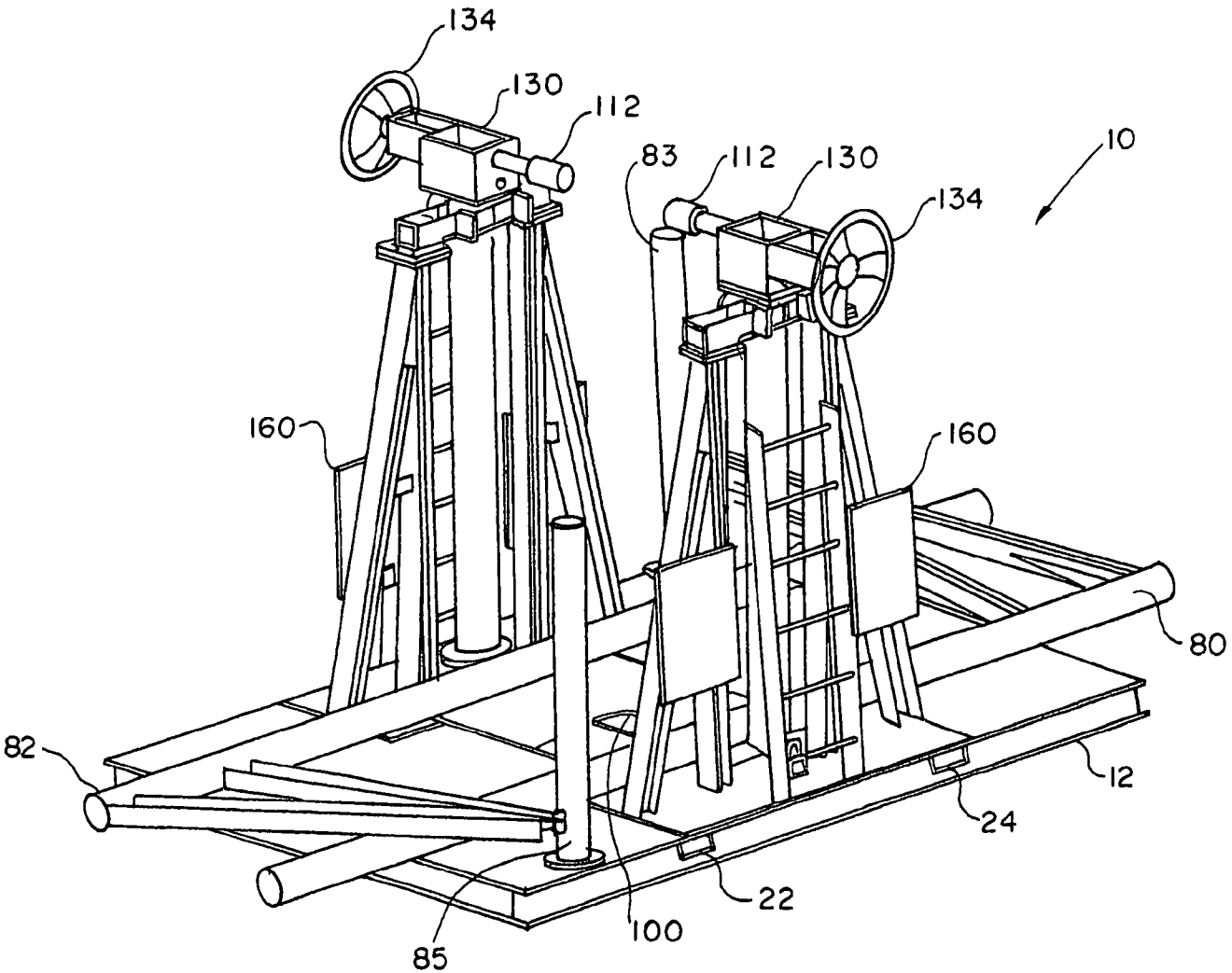
FIG. 4 is a perspective view illustrating the power swivel unit removed and the supporting poles in stowed position.

The Jen pole 82, carries a motor 94 with a retractable cable 96. A free end of the cable 96 is configured for engaging power tongs 98 which are used for engaging the wellhead to allow access to the top of the well bore 65. When not in use, the upper portions of the Jen poles 80 and 82 can be detached from the bases 83, 85 and moved into a stowed position, as shown in FIG. 4. The bases 83 and 85 of the Jen poles 80, 82 are firmly secured to the base 12 by suitable clamps or other engagement means.

An opening 100 is formed in the base 12 to allow the rotating tool 62 to extend through the base 12 in general alignment with the well bore 65. The operations are conducted through the opening 100.

Figure 5:
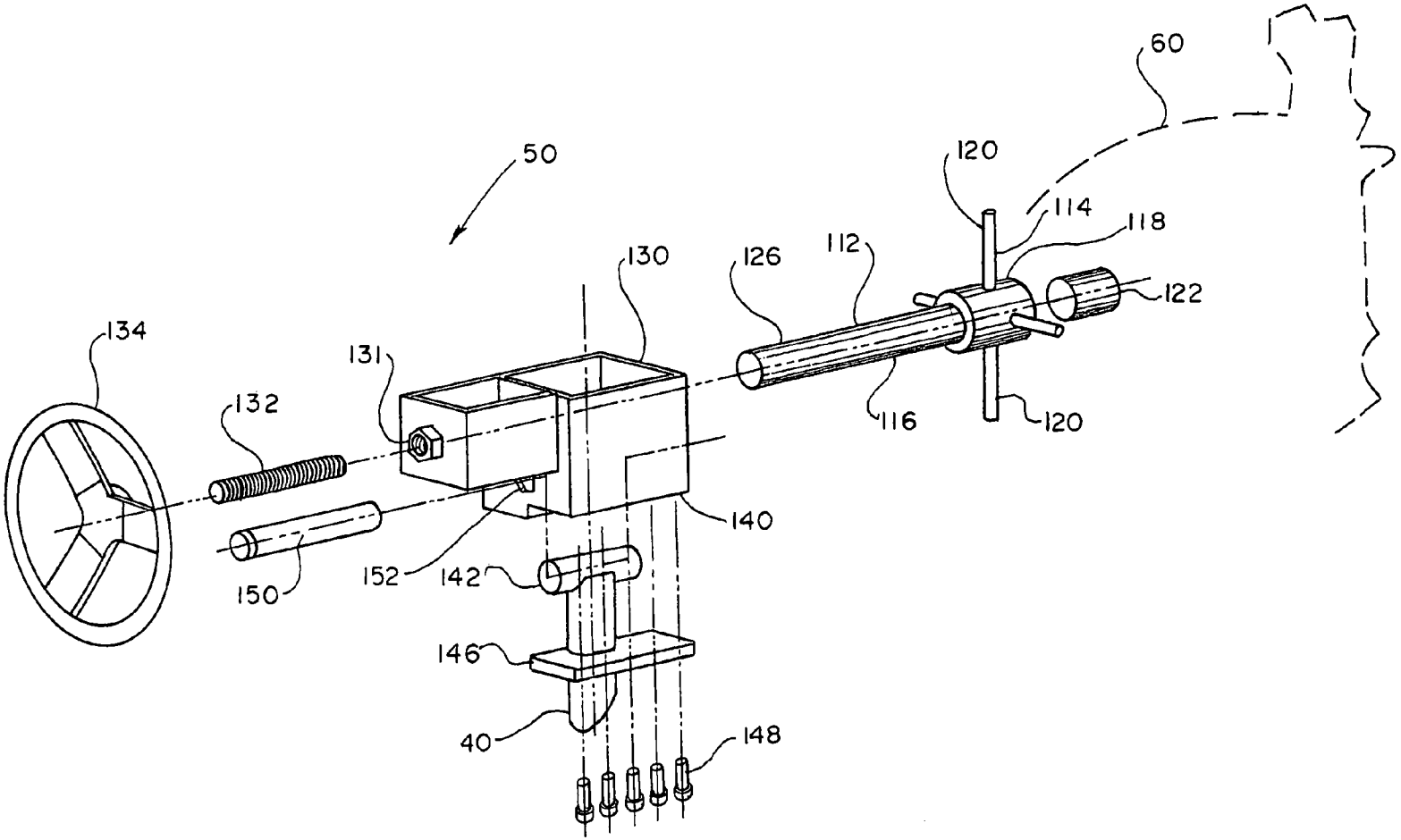
FIG. 5 is a detail exploded view of the power swivel unit alignment assembly.

Turning now in more detail to FIG. 5, one of the alignment assemblies is illustrated in more detail. It will be understood that the alignment assemblies 50, 52 are mirror images and have similar structure. As can be seen in the drawing, the alignment assembly 50 comprises a horizontal arm 112, which can be an elongated rod or pipe. Mounted on a proximal end 116 of the arm 112 is tubular member 118, which carries a plurality of spokes, or fingers 120 which are spaced about and secured to the tubular member 118. The spokes 120 are adapted for contacting the swivel unit 60 and absorb the vibration during the cutting operation while retaining the swivel unit 60 in alignment with the well bore 65. The swivel unit 60 has an engagement member 122, which operationally engages the tubular member 118.

A distal end 126 of the arm 112 extends through a box-like connector 130 and engages a tightening rod 132 which moves in the connector 130 through an opening 131. The tightening rod 132 is operationally connected to a handle 134, which an operator engages by hand. When the operator rotates the handle 134, the tightening rod 132 causes the arm 111 to move horizontally toward and away from the swivel unit 60.

A bottom 140 of the connector 130 rests on top of a horizontal tubular support 142 of the hydraulic ram or piston 40. A retaining plate 146 aligns the piston 40 with the connector 130. A plurality of retaining bolts 148 helps to detachably secure the plate 146 to the connector 130.

A rod 150 engages with the horizontal support member 142 by passing through an opening 152 formed in the lower part of the connector 130. The rod 150 retains the horizontal support member 142 in an aligned engagement with the connector 130.

In operation, when the rams or pistons 40, 42 move up and down, the arm 112 forces the guiding spokes 120 toward the swivel unit 60 and help retain the swivel unit 60 in alignment with the opening 100 and thus with the well bore 65 and casing 66.

The system 10 is further provided with several operator platforms 160 which are secured to the upright support members 28 and 30. The platforms 160 are hingedly attached to the supports 28, 30 and move between a substantially horizontal operational position and substantially vertical stowed position. The drawings illustrate the alternate positions of the operator platforms 160. When an operator stands on the platform 160 the operator can reach the handle 134 and the alignment assemblies 50, 52, thus facilitating the correct positioning of the swivel unit 60.

Figure 6:
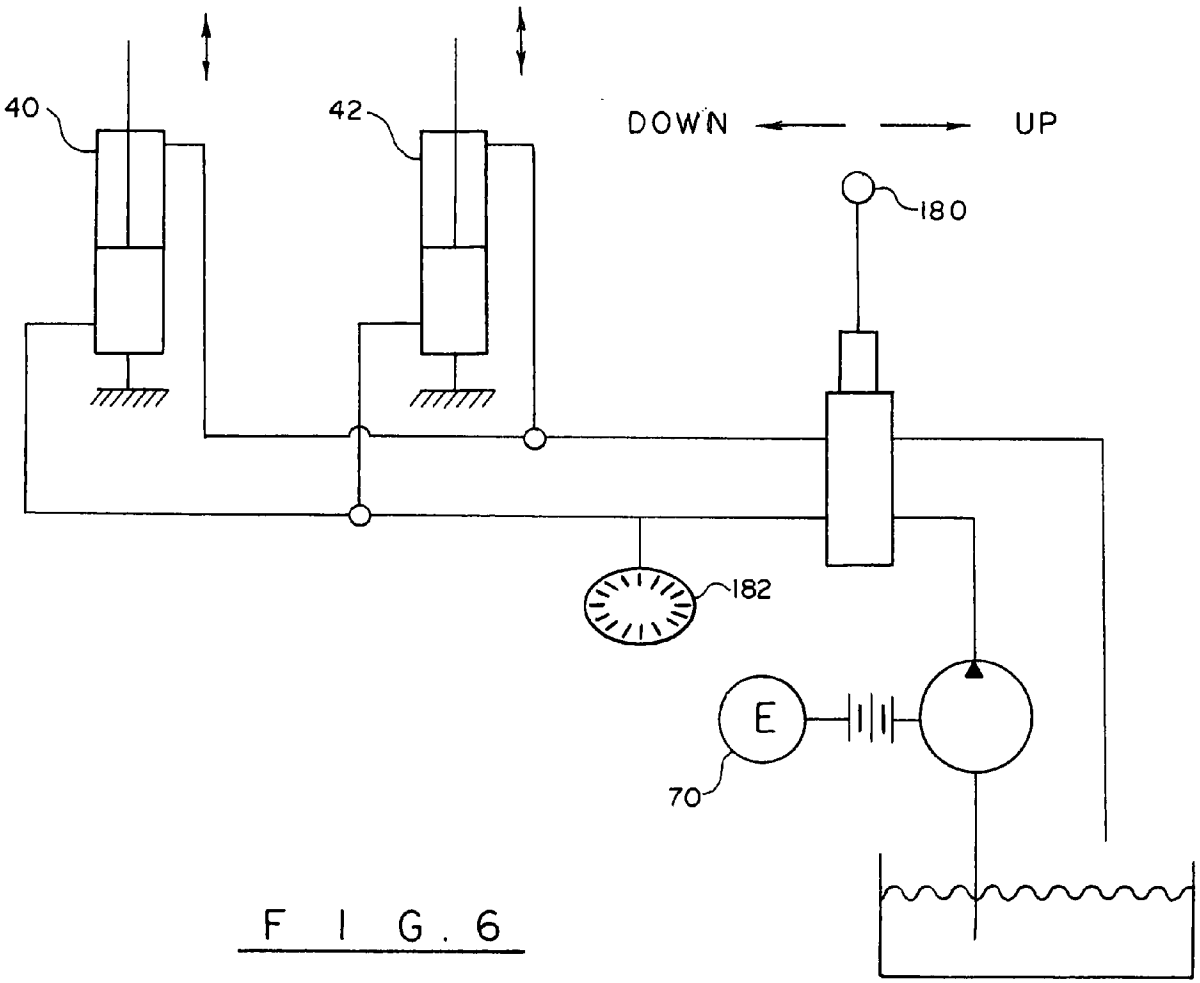
FIG. 6 is a schematic view of the dual ram hydraulic system used in the apparatus of the present invention.

Turning now to the schematic illustration of FIG. 6, the dual ram hydraulic schematic for the operation of the pistons 40, 42 is shown in detail. A handle 180 regulates movement of the rams 40, 42 up and down. The power is provided by the power unit 70. A gauge 182 mounted between the power source 70 and the pistons 40, 42, allows the operator to fine-tune the movement of the rams up and down.

Figure 7:
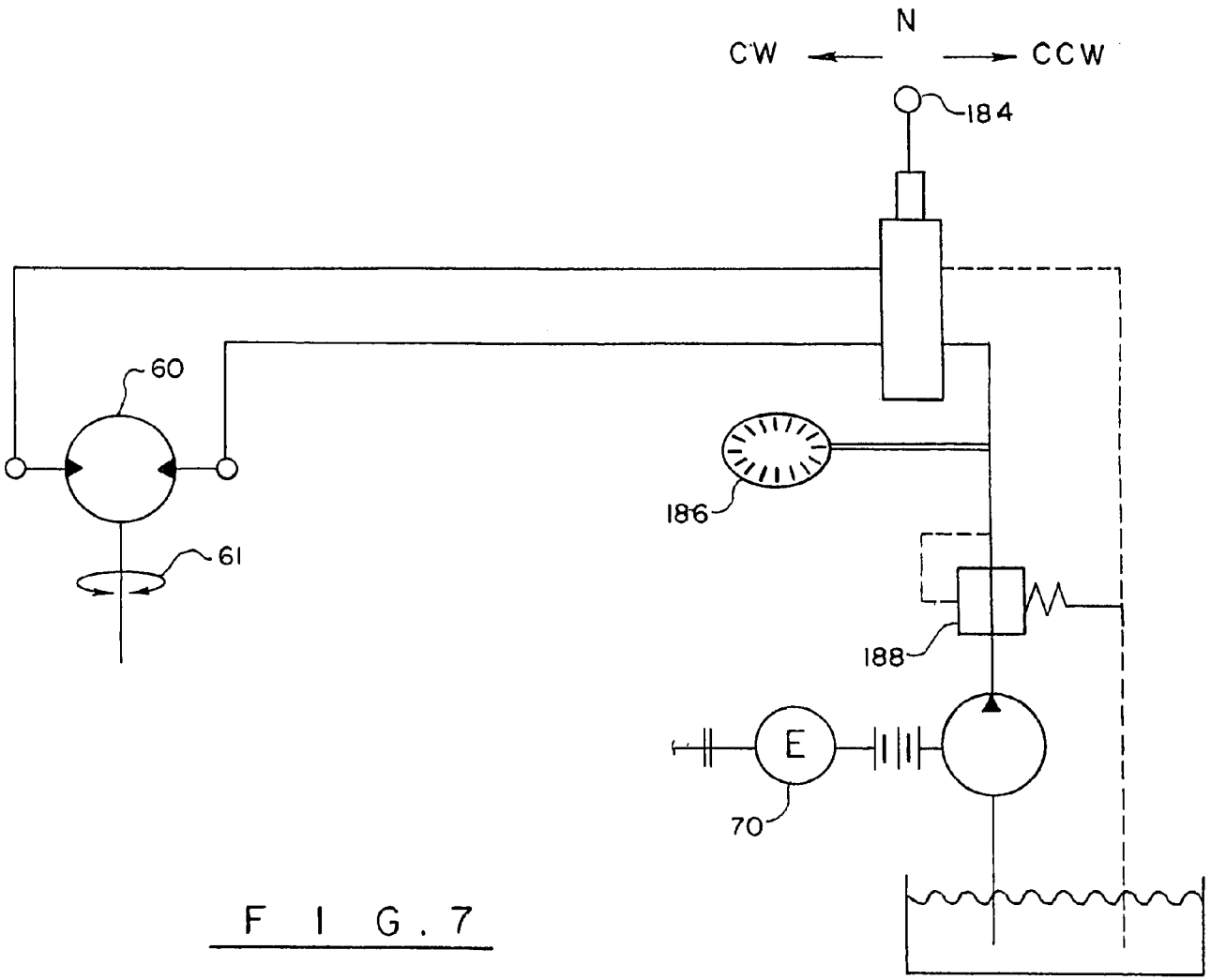
FIG. 7 is a schematic view of the power swivel hydraulic drive used in the apparatus of the present invention.

FIG. 7 schematically illustrates the hydraulic drive for the power swivel unit 60. A manual handle 184 is connected between the power source 70 and the swivel unit 60 to provide for the directional control of the swivel unit 60. The swivel unit rotates, in the direction of arrows 61 when the operator activates the swivel unit 60. A gauge 186 is mounted between the power source 70 and the swivel unit 60 allowing the operator to observe the rotational speed of the swivel unit 60 and thus of the rotating tool 62. Combined with the device 188 for adjusting the torque in incremental units, an operator can selectively increase or reduce the rotation of the tool 62 and thereby control the operation of the casing cutter 64.

In operation, the apparatus 10 is brought to the site of the well bore operations wherein plugging of the well bore becomes necessary. The unit 10 is moved to the required coordinates in relation to the well bore, while the tongs 98 are used to undo the cover of the well and allow the casing cutter 64 to be lowered into the casing 66.

The casing 66 conventionally consists of a plurality of tubulars, which have been cemented together. In most cases, the tubulars d not extend concentrically but may be shifted in relation to the axis of the adjacent tubulars. The annular spaces between the tubulars are usually cemented to prevent escape of oil or gas into the surrounding environment.

Once the casing cutter is lowered to the desired depth below the mud line 63, the swivel unit 60 is activated to transmit a downward force on the cutter blades of the casing cutter 64 and cause them to extend outwardly, as shown in FIGS. 1 and 4. Rotation of the rotating tool by the swivel unit 60 transmits torque to the casing cutter 60 and causes the cutting blade to cut through the wall of the innermost casing, which can be a 7⅝" tubular. Once the milling is complete, which can be detected by the difference in the rotating power needed to rotate the cutter 64, the operator can withdraw the cutter 64 and secure different length blades. The cutter 64 is lowered again into the casing 64 and the cutting operation of the next size tubular is conducted. The casing cutter 64 can self-align within the tubular, such that only the metal walls are milled when necessary.

The casing severing operation continues in 5-foot intervals, while the alignment assemblies 50, 52 support the swivel unit 60 and absorb the vibration. By monitoring the gauges on the control panel, the operator can control the casing cutting operation with a greater degree of precision, while avoiding the danger of downhole jamming. At the same time, the use of the swivel unit 60 allows for better control of the rotational speeds, which eliminates the danger associated with overturned cranes and the like.

By milling or cutting one pipe while inside of another a certain distance without disturbing the outer casing produces a void below the mud line in the actual casing that can be cemented by placing an expandable plug and then placing concrete on top of the plug to the desired height. This would be done successively by milling out a 15-foot window in the 7⅝" casing, then coming above that and milling out a 10-inch tubular for another 15 feet and then perhaps milling out the 12-inch tubular, etc. until the outermost casing is severed.

The extending of the hydraulic rams is done by a hydraulic motor which puts pressure onto the pistons of the cylinders, while the operator monitors the weight and pressure delivered to the pistons. The same gauge informs the operator on how much pressure is put on the blades of the casing cutter as they are raised against the surface to be cut.

Noting that the cylinders have only 5-foot stroke, it would be necessary to hold the rotating tool in a certain position using standard slips (wedges) on the base 12 and to disconnect the power swivel unit 60 before engaging the pistons again. The swivel unit 60 is moved off to the side by use of the Jen crane 80, after which the operators undo the 5-foot sub. Once that 5-foot section is removed, the cylinders 40, 42 can be retracted, the power swivel 60 can be swung back over the center of the opening 100, and re-engaged with the rotating tool 62. The rotating tool 62 is rotated while the pistons 40, 42 are activated again to slowly and gradually raise the production string and hence the casing cutter 64, and while the power swivel 60 rotates it approximately 60 to 90 RPMs until it reaches its full stroke again of another 5 feet.

At this time, the slips are placed in the cradle to hold the pipe, the power swivel is connected to its Jen crane, disconnected form the production string and swung out of the way so that the power tongs can be used to undo an additional 5-foot sub. The cylinders 40, 42 are then retracted to their lowest position, the power swivel 60 is then placed back on top of the production string through the rotating tool 42 and connected into the latching mechanisms that securely hold the power swivel onto the two pistons that will be used to raise the power swivel up as it is rotated.

The support apparatus of the present invention provides for considerable savings in the plug-and-abandonment operations at the offshore locations. It is envisioned, that the system 10 can be used for operating other downhole tools where delivery of hydraulic power is required. It is also envisioned that the apparatus of the present invention may be used in an onshore location with minor modifications.

Many changes and modifications can be made on the design of the present invention without departing from the spirit thereof. I therefore pray that my rights to the present invention be limited only by the scope of the appended claims.

I claim:

1. An apparatus for supporting downhole operations, from a deck of a rigless structure comprising: a base having an opening for allowing access to a well bore in a subterranean formation; a pair of spaced-apart vertical legs secured to and extending upwardly from the base, each of said legs comprising a movable portion adapted for vertical movement in relation to the base, top parts of each of said movable portions supporting an alignment assembly; a swivel unit mounted between alignment assemblies above said opening, said swivel unit being configured for connecting to a rotating tool for delivery of rotating force to a downhole tool, wherein each alignment assembly comprises an elongated arm carrying alignment members having a plurality of radially-extending spokes on a proximate end thereof and carrying a handle on a distal end thereof, and a tightening member secured between the handle and the proximate end to facilitate movement of the alignment members into contact with the swivel unit upon demand for supporting the swivel unit in a substantial alignment over said opening and absorbing vibration from said swivel unit; and a power source for providing power to said swivel unit and said movable portions of the legs.

2. The apparatus of claim 1, wherein a weight gauge is mounted between the power source and said movable portions for controlling the amount of power delivered to the movable portions.

3. The apparatus of claim 1, wherein a torque gauge is mounted between the power source and the swivel unit to facilitate monitoring of the amount of force delivered to the swivel unit.

4. The apparatus of claim 1, further comprising at least one crane mounted on said base for moving said swivel unit upon demand.

5. The apparatus of claim 4, wherein said at least one crane comprises a lower portion secured to said base and an upper portion detachably engaged with the lower portion.

6. The apparatus of claim 4, further comprising at least a second crane mounted on said base for moving a well bore tool upon demand.

7. The apparatus of claim 6, wherein said at least second crane comprises a bottom portion secured to said base and a top portion detachably engaged with the bottom portion.

8. The apparatus of claim 1, wherein each of said alignment assemblies further comprises a connector mounted between said arm and said tightening member, said connector being detachably secured to a top part of a respective leg.

9. The apparatus of claim 1, wherein said swivel unit is configured for operational connection to a casing cutter.

10. The apparatus of claim 1, wherein said swivel unit is operationally connected to said rotating tool extending into a casing in said well bore, said rotating tool being configured for carrying a casing cutter on a lower end thereof, and wherein said casing cutter is driven by said swivel unit to cut the well casing.

11. The apparatus of claim 1, wherein each of said vertical legs is retained in an upright position by a respective support structures erected on the base.

12. The apparatus of claim 11, further comprising at least one operator platform secured to said support structure; said operator platform being movable between a substantially horizontal position operation position and a substantially vertical stowed position.

13. The apparatus of claim 1, wherein said power source is a hydraulic motor.

14. The apparatus of claim 1, wherein said base is mounted on a pair of skid members allowing sliding movement of the base along a deck of a floating structure.

15. The apparatus of claim 1, wherein said base is configured for lifting by a fork truck.

16. An apparatus for supporting a casing cutter from a deck of a rigless floating vessel, the apparatus comprising: a base having an opening for allowing access to a well bore in a subterranean formation; a pair of spaced-apart vertical legs secured to and extending upwardly from the base, each of said legs comprising a movable portion adapted for vertical movement in relation to the base, top parts of each of said movable portions supporting an alignment assembly; a swivel unit mounted between said alignment assemblies above said opening, said swivel unit being configured for connecting to a rotating tool for delivery of rotating force to the casing cutter, said swivel unit exerting downward force on said rotating tool for activating the casing cutter, wherein each alignment assembly comprises an elongated arm carrying an alignment member having a plurality of radially-extending spokes on a proximate end thereof and carrying a handle on a distal end thereof, and a tightening member secured between the handle and the proximate end of each arm to facilitate movement of the alignment members into contact with the swivel unit upon demand so as to support the swivel unit in a substantial alignment over said opening in the base and absorb vibration from said swivel unit; and a power source for providing power to said swivel unit and said movable portions of the legs.

17. The apparatus of claim 16, further comprising a means for controlling amount of downward force exerted by said swivel unit and for controlling amount of torque transmitted by said swivel unit to said rotating tool.

18. The apparatus of claim 17, wherein said control means comprises a first gauge mounted between the power source and said movable portions of the legs, and a second gauge mounted between said power source and the swivel unit.

19. The apparatus of claim 16, further comprising a first crane mounted on said base for moving said swivel unit upon demand and a second crane mounted on said base for moving a well bore tool upon demand.

20. The apparatus of claim 16, wherein said power source is a hydraulic motor.

21. The apparatus of claim 16, wherein said base is mounted on a pair of skid members allowing sliding movement of the base along said deck of said rigless floating vessel, said base being configured for lifting by a fork truck.

* * * * *